United States Patent [19]

Vermette

[11] Patent Number: 4,895,543

[45] Date of Patent: Jan. 23, 1990

[54] ASSEMBLY TREE FOR PHYSICAL THERAPY AND EXERCISE

[75] Inventor: John E. Vermette, Baltimore, Md.

[73] Assignee: Baltimore Therapeutic Equipment Co., Hanover, Md.

[21] Appl. No.: 184,105

[22] Filed: Apr. 20, 1988

[51] Int. Cl.[4] ..... A63H 13/02

[52] U.S. Cl. ..... 446/105; 272/93

[58] Field of Search ..... 272/113, 93; 273/153 R, 273/153 P, 156, 157 R, 160; 446/128, 122, 123, 105, 104, 117; 52/733, 720

[56] References Cited

U.S. PATENT DOCUMENTS

| | | | |
|---|---|---|---|
| 3,162,973 | 12/1964 | Christiansen | 446/128 |
| 3,657,838 | 4/1972 | Hanning | 446/105 X |
| 4,129,960 | 12/1978 | Gale | 446/128 |
| 4,193,221 | 3/1980 | Beck | 446/105 |
| 4,389,808 | 6/1983 | Podell et al. | 446/123 |
| 4,775,349 | 10/1988 | Short et al. | 446/123 X |

FOREIGN PATENT DOCUMENTS

| | | | |
|---|---|---|---|
| 2508987 | 1/1983 | France | 446/122 |

*Primary Examiner*—Richard J. Apley
*Assistant Examiner*—H. Flaxman
*Attorney, Agent, or Firm*—James J. Brown

[57] ABSTRACT

A device is provided for rehabilitation, exercise and therapy which consists of an upright standard to which are attached in predetermined order and position, arrays of modules made up of interchangeable units attached together in varying configurations. Assembly and disassembly of the modules from the standard in the proper sequence and position accurately simulates various stretching, bending, lifting and stooping operations encountered in occupational and other efforts.

15 Claims, 6 Drawing Sheets

ASSEMBLY TREE FOR PHYSICAL THERAPY AND EXERCISE

SUMMARY OF THE INVENTION

The present invention is concerned with a device for rehabilitation, exercise and physical therapy in which a number of modules of different size weight and shape are removably attached to an upright standard in a specific location and orientation. Therapy and exercise are provided by having the individual dissamble and reassemble the array of modules in a specific, predetermined position and orientation on the standard. Because of the varying dimensions and weight of the modules and their position on the upright standard, the device requires the expenditure of work effort by the back and limbs in a way which simulates many commonly encountered work tasks and thereby provides therapy and exercise for the individual in a manner closely approximating commonly encountered work situations.

BACKGROUND OF THE INVENTION

Sufficient and effective rehabilitation and physical therapy often require a regimen which simulates as closely as possible the actual physical operations which the individual will encounter in the work place. Unfortunately, while many of the devices which have been developed for use in physical and rehabilitative therapy provide reasonably good exercise programs for particular muscles and joints, these devices often do so in a way which does not accurately simulate the actual operations which the individual will be required to perform in every day life.

Many jobs for example, frequently require the individual to either remove or replace items of different size and weight from shelves located at the different heights, and it is not uncommon for individuals engaged in this activity to experience various back and other disorders associated with lifting. Similarly, operations which require lifting in other contexts or stretching, bending over or crouching can all produce various disorders associated with the back and limbs of the body.

Clearly, to provide effective rehabilitation and therapy, as well as testing and evaluation of individuals who have experienced these sorts of disorders, it is desirable to employ equipment which simulates as closely as possible the type of operation which the individual will be required to perform in his work so that maximum strengthening and rehabilitation of the associated muscles can be achieved. Although many of the numerous devices currently employed for rehabilitative therapy can be helpful in these situations, it is clearly advantageous to have available equipment which can readily and quickly be employed in various modes to simulate almost exactly the precise operations of lifting, stretching, and removing and replacing items of various weight and size in different locations.

Accordingly, it is an object of the present invention to provide a device for physical and rehabilitative therapy, testing and exercise which provides for effective simulation of operations in which the individual must remove or replace items of various weight and size in different locations and at different heights.

It is a further object of the present invention to provide a device for physical rehabilitation therapy and evaluation which requires that the individual using the device coordinate various movements and operations in a prearranged regimen to simulate actual conditions which are encountered in the work place.

It is a still a further object of the present invention to provide a system for rehabilitative therapy, exercise and evaluation which provides a wide range of work simulating operations and which can be readily adjusted to accommodate the requirements of the individual.

DETAILED DESCRIPTION OF THE INVENTION INCLUDING A PREFERRED EMBODIMENT THEREOF

In accordance with the present invention, a device for rehabilitation, exercise and physical therapy and evaluation is provided which comprises an upright, vertical support member mounted on a base and provided with means for removably detaching in a predetermined position and order on the support a plurality of modules of different size, weight and configuration. Each of the modules is made up of one or more interchangeable cubical units which can be attached to one another to form the modules which are then attached to the vertical support in various predetermined, specific positions and configurations. Conveniently, the modules are grouped together in arrays which are located on the upright standard at different heights in order to simulate different work operations and require the use of different limbs and muscles. The modules are formed by attaching together groupings of hollow interchangeable cubes which are provided with appropriate means for attaching them to each other at differing angles and positions. The invention though not limited thereby in its scope will, however, be more fully understood and appreciated by having reference to the drawings which are illustrative of a preferred embodiment thereof.

Figure 1:
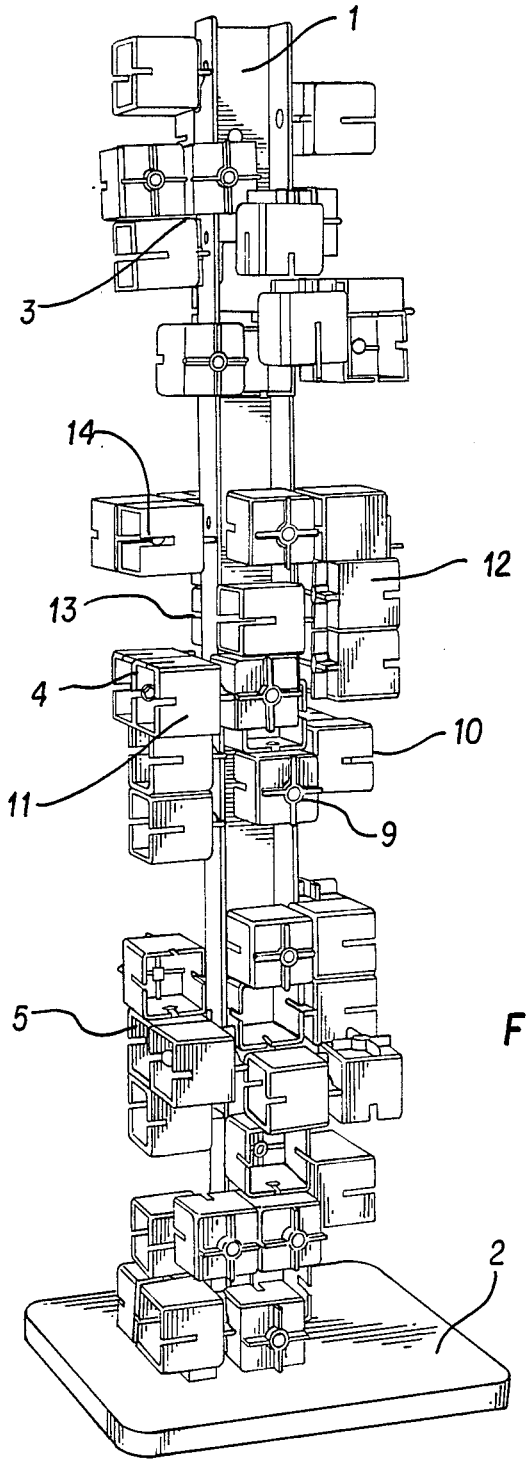
FIG. 1 is front view of the device of the present invention illustrating the front and left sides thereof.
Figure 2:
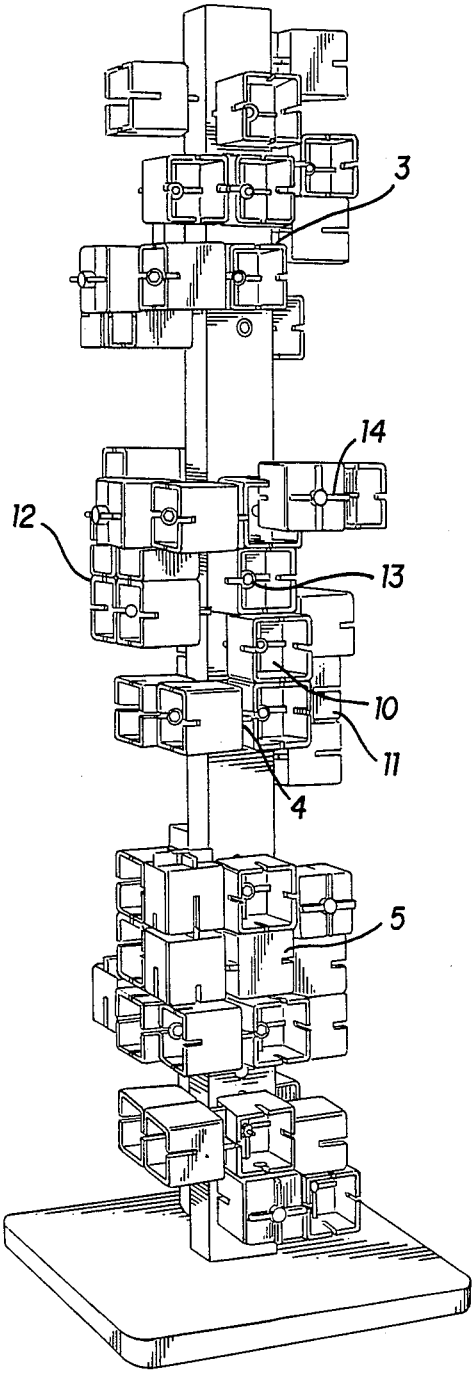
FIG. 2 is a rear view of the device of the present invention illustrating the rear and right sides thereof.

Directing attention to FIGS. 1 and 2, an upright standard 1 which is typically about seven feet tall, but whose height can be varied as desired, is attached to a flat base 2 of sufficient size and weight to rigidly support the entire structure. Three groupings of modules 3, 4 and 5, are removably attached to the upright standard 1. Conveniently, the standard 1 can be a U-shaped channel and has holes drilled at predetermined positions to accommodate attachment at specific locations of the modules forming each of the respective three groupings. Also, to facilitate assembly of the modules in the correct position, the component blocks or cubicles can be of different colors or numbered in appropriate sequence.

For purposes of illustration, specific attention is given to the assembly of modules in middle section 4 of the device shown in FIGS. 1 and 2. It will be seen that middle section 4 consists of 6 modules numbered 9 through 14 which are each attached to the upright standard 1 in a pre-determined position. Because of the configuration of the modules, it is necessary that they be placed on the upright standard 1 in a particular sequence and orientation in order that they cooperate and fit with one another in the final array shown in FIGS. 1 and 2 of the drawings. It will further be apparent that the modules of section 4 designated 9 through 14 have different numbers of identical, interchangeable cubical components or boxes and these are themselves connected together in different orientations. Specifically, module 9 is formed of two cubes, modules 10 and 13 each are formed from four cubes, modules 11 and 12 are formed from six cubes each, and module 14 is formed from three cubes. FIGS. 5 through 10 illustrate sequentially the assembly of modules 9 through 14 respectively with module 9 being first implaced by means of a bolt followed by modules 10, 11, 12, 13 and lastly, module 14. It will be appreciated by carefully studying the illustrations that it is necessary that each module be erected on the standard in the proper orientation and position and in the proper sequence in order for all of the modules to fit in their designated places in the proper manner.

Figure 3:
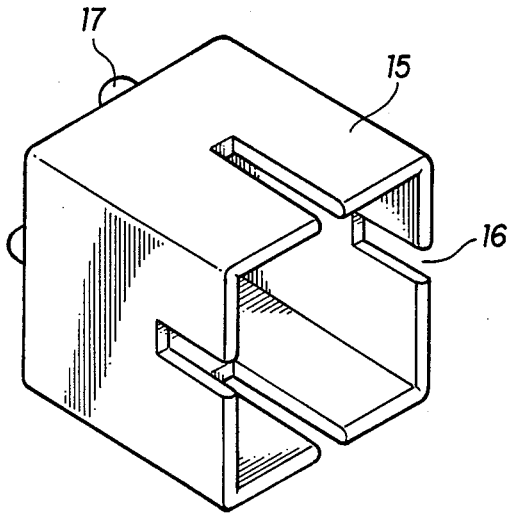
FIG. 3 is a perspective view of one of the interchangeable component cubes used to form the modules of the present invention.
Figure 4:
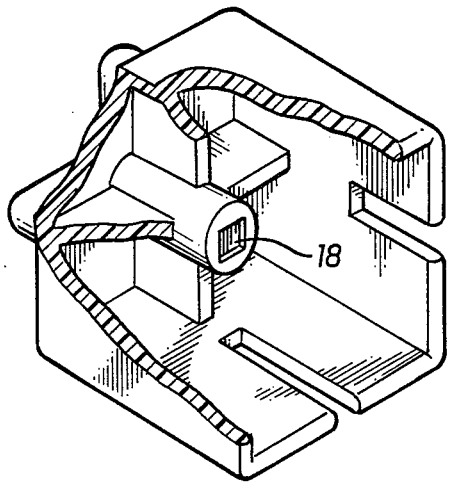
FIG. 4 is a partial cut-away view of the cube of FIG. 3 illustrating the interior thereof.
Figure 6:
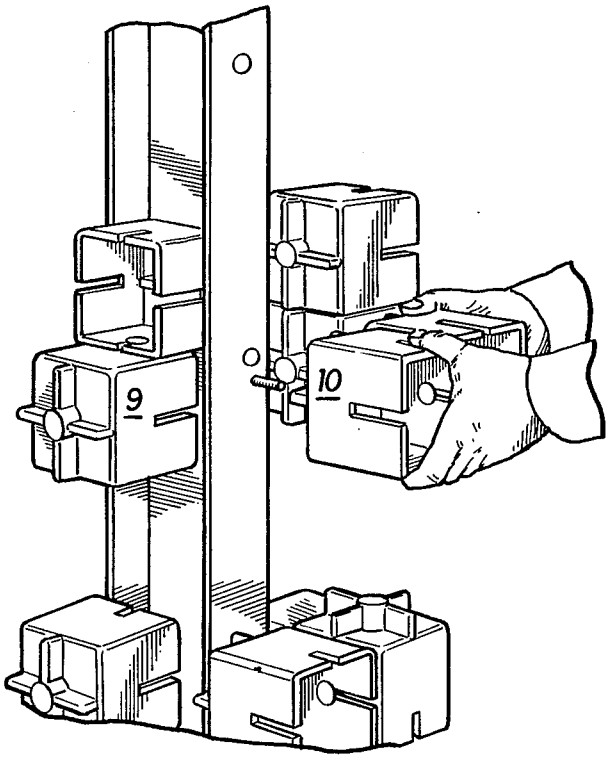
FIGS. 5 through 10 illustrate sequentially the assembly of the middle section of the assembly tree shown in FIGS. 1 and 2 of the using modules numbered 9 through 14.
Figure 5:
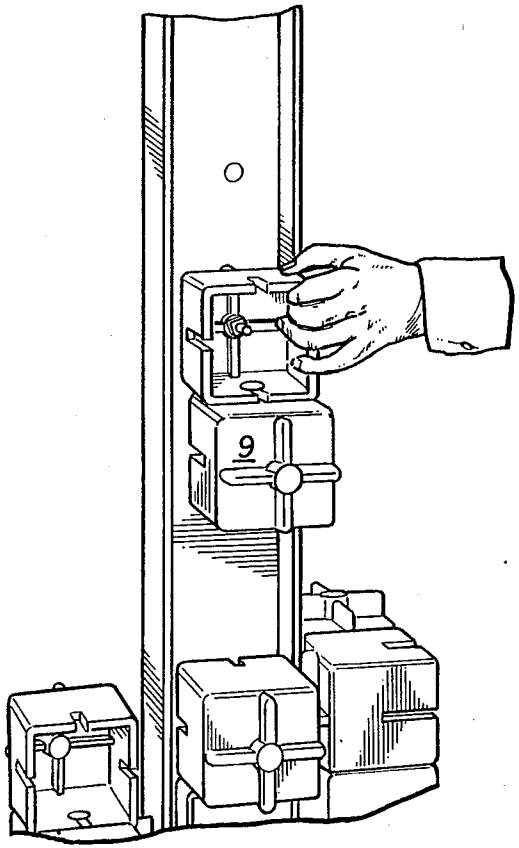
Figure 8:
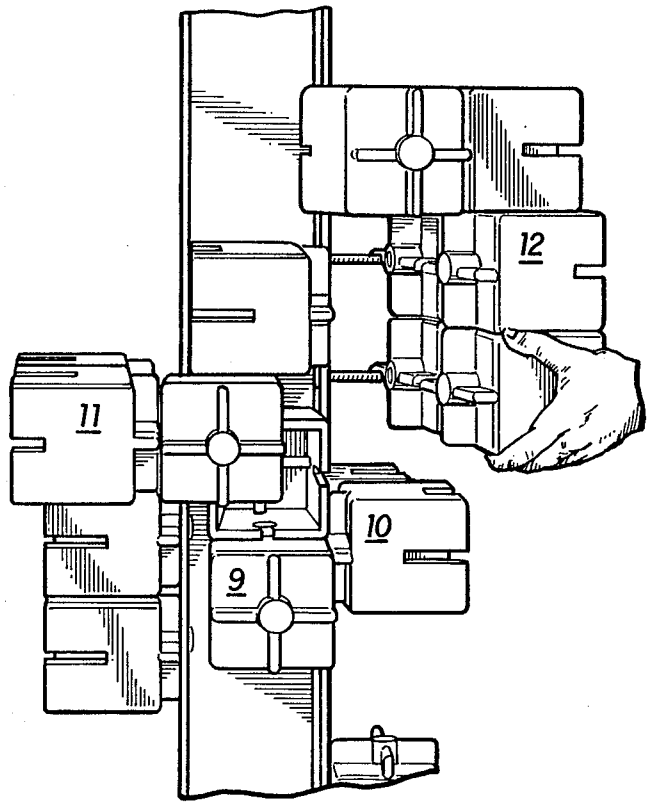
Figure 7:
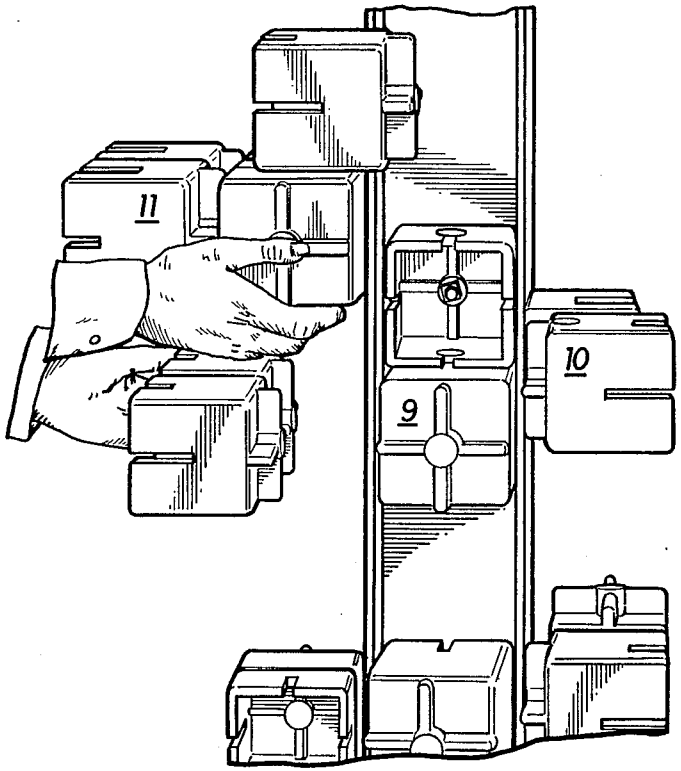
Figure 10:
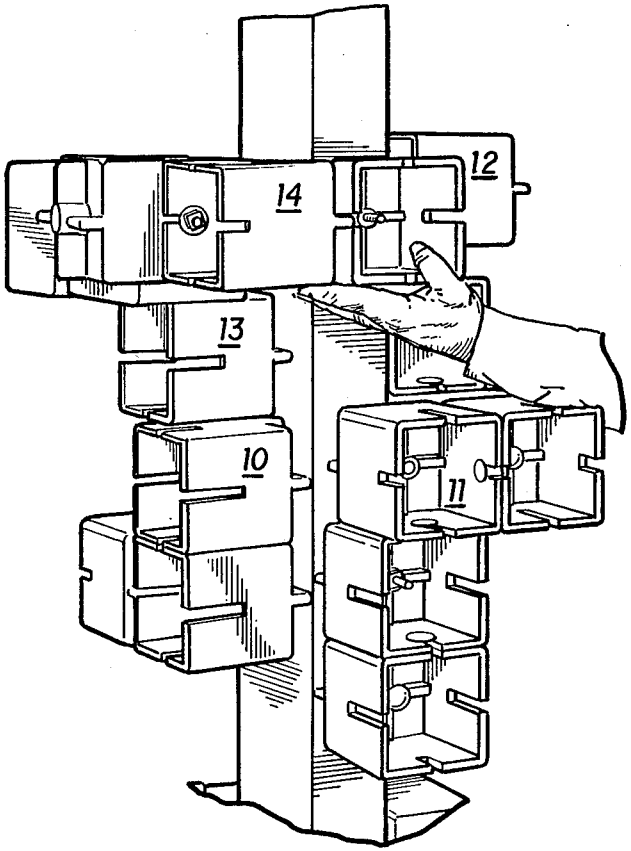

Directing attention to FIGS. 3 and 4 of the drawings, the interchangeable cubical component which are used to form the modules of the present invention are illustrated in greater detail. As can be seen, the units are essentially cubical in shape and hollow with one side being left open. The side of the cubical opposite the open side is provided with a cruciform projection or crossed ribs 17 being a hole or passage 18 which penetrates from inside the box through the outside of the cruciform 17 to permit implacement of a bolt or similar attachment. Slots 16 are provided in the other four sides of the cubical to also accommodate attachment means such as bolts. Conveniently, the cubes used in the present invention can be formed of heavy plastic and of predetermined size, although, of course, other materials can be used. It will also be apparent that the actual structure and mode of attachment of the cubes can be varied considerably within the scope of the invention. Although it is convenient that the cubes be of the same size and shape and adopted to be bolted to one another to form the modules of the invention; cubes or other modes of attachment such as by adhesive bonding can be employed.

Figure 9:
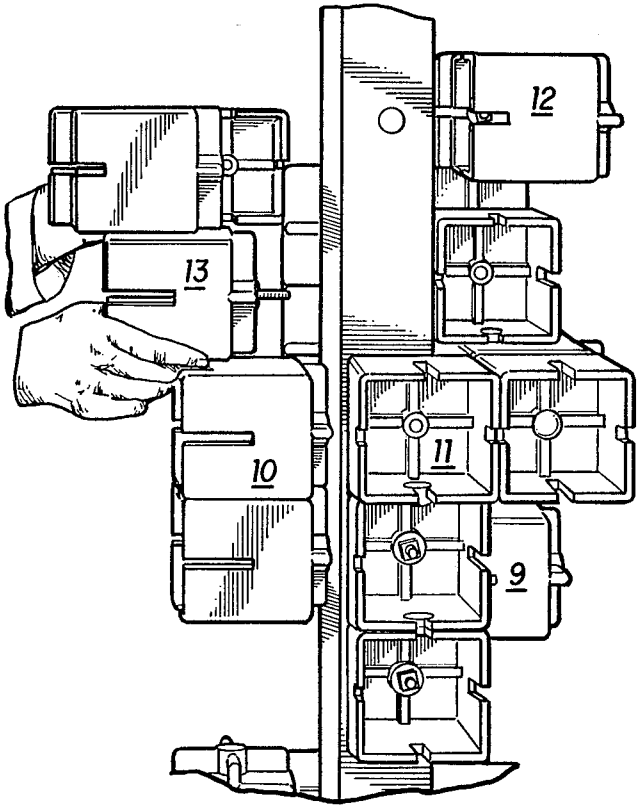
Figure 11:
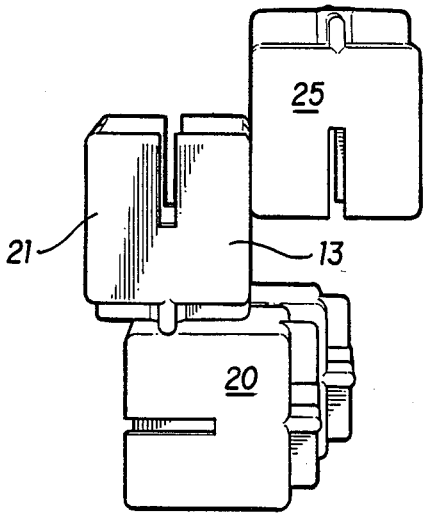
FIG. 11 is a top view of module 13 from middle section of the device shown in FIGS. 1 and 2.
Figure 12:
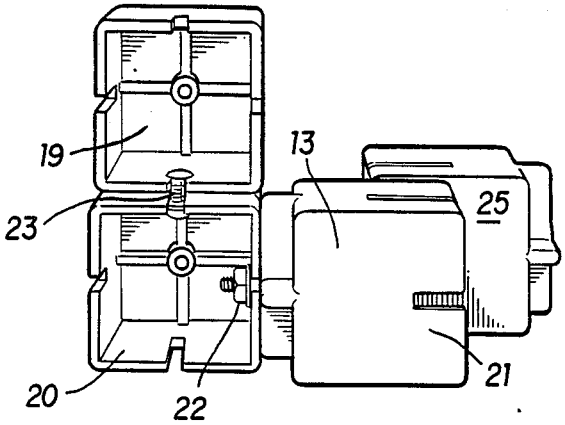
FIG. 12 is a rear view of module 13 shown in FIG. 11.

FIGS. 11 and 12 illustrate in somewhat greater detail the actual manner in which the four cubes are joined together to form module 13. It will be understood that this module is illustrative of the manner in which the other five modules shown in FIGS. 5 through 10 are joined together from the cubical boxes. As shown in FIG. 12, cube 19 is attached at its side to the side of cube 20 by means of a bolt and nut 23 which passes through the respective slots in the sides of the two cubes. Cube 21 is also jointed to cube 20 by means of a bolt which passes through the hole in the base of the cube 21, and the cruciform on its base. The remaining cubes are attached to one another similarly by means of bolts and the entire structure then mounted in proper sequence on the standard 1 as shown in FIG. 9 of the drawings.

It will be evident that by changing the configuration, number and size of the respective modules as well as the holes provided for attachment on the standard, their positioning on the standard can also be changed so that essentially an infinite number of possible prearranged structures can be realized having modules and groups of modules of different sizes and shapes requiring specific, sequential positioning. By arranging the modules in groups or arrays at different heights, it is also possible to simulate various lifting, stretching and assembly procedures at different elevations, both to exercise different parts of the body and also accommodate individuals of different stature. By requiring the individual to assume different positions and extend the body and limbs in different ways, a wide range of activities can be simulated accurately to assist the individual in rehabilitation; exercise and therapy.

Since the size and configuration of each modules and the provisions for attachment of the modules are selected to require a specific and exclusive order and placement of the modules in their respective arrays on the standard, a degree of concentration and attention are required of the individual removing or replacing the modules. This is particularly important in alleviating boredom and tedium from the therapy and exercise regimen, and further reduces the individuals attention to real or perceived discomfort which may be associated with the therapy and exercise.

What is claimed:

1. A device for exercise and physical evaluation and therapy, said device having a specific predetermined configuration when fully assembled and comprising a vertical standard with one or more arrays removably attached thereto, each of said arrays having a specific, predetermined configuration consisting of a plurality of preassembled modules each consisting of one or more interlocking units of specified weight and shape, at least one module in each array consisting of more than one unit and each module having its own specific configuration, disposition and orientation within its array on said standard and being attached to said standard in a specific location and sequence to achieve said specific predetermined configuration when fully assembled and to permit proper attachment of the other modules in the array, said standard being provided with means for said attachment of modules disposed in a predetermined pattern such that said attachment of said modules results in the fully assembled device having said specific predetermined configuration.

2. The device of claim 1 wherein each of said units making up a module is cubical in configuration and provided with means for attachment to other cubical units and said support.

3. The device of claim 2 wherein said cubical units are identical to one another.

4. The device of claim 1 wherein said arrays of modules are disposed at different heights on said support member.

5. The device of claim 1 wherein there are 3 arrays on said support member.

6. The device of claim 2 wherein said cubical units are hollow with one side being open and each of the remaining five sides having provision for attachment to other units or to the support member.

7. The device of claim 1 wherein said means for attachment are holes in said standard to permit bolting of said modules to said standard.

8. The device of claim 1 wherein said vertical standard is mounted on a base.

9. The device of claim 1 wherein said vertical standard is a unitary elongated member.

10. The device of claim 9 wherein said standard has a "U" shaped cross-section configuration.

11. A method for physical evaluation, exercise and therapy comprising assembling in a predetermined order and sequence on an upright vertical standard, a plurality of pre-assembled modules, each having specific configuration and adapted for removable attachment to said standard in a predetermined order, to permit proper attachment of the other modules so that, when fully assembled, each of said modules is disposed in a specific disposition and orientation in one or more arrays on said standard and each module consists of one or more units of specified weight or shape.

12. The device of claim 1 wherein a plurality of said arrays are attached to said standard.

13. The device of claim 1 wherein each of said modules is performed from one or more cubical units of uniform size and shape to have a specific size configuration.

14. The method of claim 11 wherein a plurality of said arrays are attached to said standard.

15. The method of claim 11 wherein each of said modules is preformed from one or more cubical units of uniform size and shape to have a specific size and configuration.

* * * * *